US005368244A

United States Patent [19]

Melillo et al.

[11] Patent Number: 5,368,244

[45] Date of Patent: Nov. 29, 1994

[54] THREAD BRAKE

[75] Inventors: Michele Melillo, Galbiate, Italy; Kurt A. G. Jacobsson, Ulricehamn, Sweden

[73] Assignee: Iro AB, Ulricehamn, Sweden

[21] Appl. No.: 859,699

[22] PCT Filed: Oct. 16, 1990

[86] PCT No.: PCT/EP90/01749

§ 371 Date: Jun. 5, 1992

§ 102(e) Date: Jun. 5, 1992

[87] PCT Pub. No.: WO91/05728

PCT Pub. Date: May 2, 1991

[30] Foreign Application Priority Data

Oct. 16, 1989 [SE] Sweden ..... 8903414
Mar. 28, 1990 [SE] Sweden ..... 9001136

[51] Int. Cl.[5] ..... B65H 59/24; B65H 59/34

[52] U.S. Cl. ..... 242/149; 242/154

[58] Field of Search ..... 242/147 R, 147 A, 149, 242/150 R, 150 M, 152.1, 153, 154

[56] References Cited

U.S. PATENT DOCUMENTS

| | | | |
|---|---|---|---|
| 2,222,847 | 11/1940 | Kent | 242/153 X |
| 2,397,153 | 3/1946 | Naumann | 242/154 |
| 2,556,291 | 6/1951 | Nelson | 242/154 |
| 2,618,445 | 11/1952 | Buder | 242/154 |
| 2,640,662 | 6/1953 | Te Strake | 242/154 |
| 2,646,941 | 7/1953 | Borges, Jr. | 242/147 R |
| 2,738,141 | 3/1956 | Klein | 242/154 |
| 2,754,071 | 7/1956 | Furst et al. | 242/154 |
| 2,932,151 | 4/1960 | Heffelfinger et al. | 242/154 X |
| 3,191,885 | 6/1965 | Jones et al. | 242/154 |
| 3,753,535 | 8/1973 | Zollinger | 242/152.1 |
| 4,030,683 | 6/1977 | Eckholt | 242/149 |
| 4,249,580 | 2/1981 | Budzyna | 242/149 X |
| 4,274,512 | 6/1981 | Goelz | 242/149 X |
| 4,297,834 | 11/1981 | Franzen | 242/149 X |
| 4,641,688 | 2/1987 | Gehring | 242/149 X |
| 4,782,653 | 11/1988 | Yanobu | 242/149 X |

FOREIGN PATENT DOCUMENTS

WO9011397 4/1990 WIPO .

*Primary Examiner*—Stanley N. Gilreath
*Attorney, Agent, or Firm*—Flynn, Thiel, Boutell & Tanis

[57] ABSTRACT

In a thread brake, which comprises at least one brake element (B) adapted to be moved relative to a counter brake element ($B_G$), said brake elements acting on the thread in braking positions and being adapted to be displaced up to and into a threading position in which the thread can be moved undecelerated through the thread brake, and in the case of which a brake element adjustment device is provided, the threading position of the thread brake ($F_K$, $F_L$, $F'_L$) can be established with the aid of a drive means (A) of said adjustment device, said thread brake having provided therein air guide surfaces (L), which, in the threading position, define an air guide passage used for automatic, pneumatic threading of the thread (Y) by means of a stream of air.

26 Claims, 4 Drawing Sheets

THREAD BRAKE

FIELD OF THE INVENTION

The present invention refers to a thread brake, and more particularly, to a thread brake which permits automatic threading of a thread.

BACKGROUND OF THE INVENTION

In a thread brake, the thread passing through the brake is mechanically decelerated by means of squeezing and/or deflection. The thread brake constitutes a weak point in the thread path when threading is carried out for the first time or when it is carried out after thread breakage because the thread has to be threaded by hand in some cases through a plurality of thread brakes, and this is time-consuming and complicated. The advantages with regard to ease of handling and stop periods gained by an automatic threading device provided for other components along the thread path are substantially impaired by the manual threading operation in the thread brakes.

This applies to the lamella brakes according to U.S. Pat. No. 4,641,688 or DE-A-21 31 302, in the case of which two lamellae are resiliently pressed against each other or in the case of which one lamella is pressed against a fixed stop means, as well as to the known socalled deflection brakes in the case of which thread guide elements are manually aligned with respect to each other by folding two holding arms towards one another before the thread is threaded by hand.

In the case of a controlled thread brake known from CH-A-310 476, a brake element is pressed against a counter brake element consisting of a tensioned braking strip. The brake element is connected to a cam drive means and it is even adapted to be completely lifted off the counter brake element.

WO 90/11397 describes that cam-controlled thread tensioners and thread brakes with cam-controlled braking fingers are displaced to a threading position for the purpose of threading the thread. However, this arrangement does not comprise any air guide surfaces.

SUMMARY OF THE INVENTION

Accordingly, it is an object of the present invention to provide an improved thread brake, which permits automatic threading of the thread. For carrying out the first threading operation or for carrying out a threading operation after thread breakage, the thread brake will be displaced to the threading position and a stream of air will be produced in the air guide passage, said stream of air threading the end of the thread automatically through the thread brake. The threading operation is carried out automatically with little expenditure of time. The stream of air can be produced either within the thread brake or outside thereof. The air guide surfaces prevent a lateral deviation of the stream of air as well as of the thread, and they guarantee that the free end of the thread flies through the thread brake rapidly and without getting entangled.

A preferred variation, the drive means is capable of adjusting the threading position on the one hand and of modulating the braking effect on the other. If desired, this can be done by remote control or automatically.

The case of the embodiment according to claim 5, the drive means displaces brake elements in both directions. This will be expedient with regard to a rapid start of operation after threading because the drive means will readjust the thread brake to a predetermined braking effect.

When a thread breakage detector detects thread breakage, the drive means will move the thread brake to the threading position. A pressure source will generate a stream of air which will thread the thread end. As soon as the thread breakage detector detects that the thread is present, the threading position will be given up and the pressure source will be deactivated. The thread brake is again ready for operation without delay.

The automatic threading operation is initiated upon actuation of the drive means. This can be done by remote control. Manual actuation is imaginable as well.

The air guide surfaces are provided for effecting automatic threading by means of the stream of air.

The brake elements are annular thread eyes provided with axial extensions which form a largely closed air guide passage. Thread brakes which have already been in operation can subsequently be equipped with these means by replacing short thread eyes by axially extended thread eyes.

The air guide surfaces are arranged on holding arms, which are displaced to their guiding position by the movement of said holding arms to the threading position. It is also imaginable to arrange the air guide surfaces on the holding arms such that they are movable and to displace them to the guiding position with the aid of drive means when the threading position is being taken up.

It is another object of the present invention to provide a thread brake wherein the brake elements are lamellae. The air guide surfaces provided on the surfaces of the lamellae guide in the threading position the stream of air which will carry out the threading operation.

In the threading position, the lamella and the raised portion jointly guide the stream of air. The stream of air will even be able to urge the lamella to the threading position.

The thread is prevented from deviating laterally during the threading operation. The stream of air is guided and oriented.

It is yet another object of the present invention to provide a thread brake wherein the brake elements are a lamella and a raised portion. An electromagnet will directly influence the brake element via an air gap. Contact pressure on the raised portion can be modulated in a sensitive manner, and the threading position can be adjusted. This arrangement, in the case of which the metallic lamella is directly acted upon by the magnet, is uncomplicated from the structural point of view. In the threading position, the lamella contributes actively to the thread guiding operation during the threading process.

The contact pressure of the brake element can be adjusted coarsely by swivelling the holder. Independently of the respective swivel position of the holder which has been chosen, an unchanging spatial relationship between the magnet and the brake element will be maintained so that the force of the magnet applied to the lamella will become effective in an optimum manner. This will be expedient for threading because the magnet need not be re-adjusted to the lamella after the threading operation.

Normally, it will suffice to use one threading air nozzle. It is, however, also possible to provide a plurality of threading air nozzles. In addition, it is also imaginable to structurally combine a pressure nozzle and a suction nozzle.

Finally, also a threading air nozzle having an adjustable blowing direction can, in accordance with claim 20, carry out or assist in the threading operation.

BRIEF DESCRIPTION OF THE DRAWINGS

Referring now to FIG. 1, a thread brake $F_K$ (commonly known as a crocodile brake), which is suitable for automatically threading a thread Y, is provided with a basic frame or housing member G on which two braking members formed as holding arms 3 are adapted to be swivelled about spaced, parallel pins 4. Gears 5, which are in mesh with one another, connect the two holding arms 3 such that they will carry out a joint spreading movement in opposite directions. A drive means A acts on one of the gears 5. Both holding arms 3 are spread apart by means of springs (arrows 10), which are not shown. The biasing force of the springs is adapted to be adjusted. The holding arms 3 have attached thereto brake elements B by means of holding clips 11, said brake elements B being displaced relative to each other in the thread passing direction and consisting of thread eyes 2, which are axially extended in comparison with conventional, annular thread eyes.

A stationary thread eye 1 is provided at the basic member G in an inlet opening on the feed side, said thread eye 1 being preceded by a pressure nozzle 8, which is adapted to be connected to a pressure source P, 9. Alternatively, pressure nozzle 8 can be secured to the basic member G, in place of thread eye 1. Just as the pressure source P, the pressure nozzle 8 can be separated from the thread brake. Ultimately, only the stream of air must become effective in said thread brake.

Figure 2:
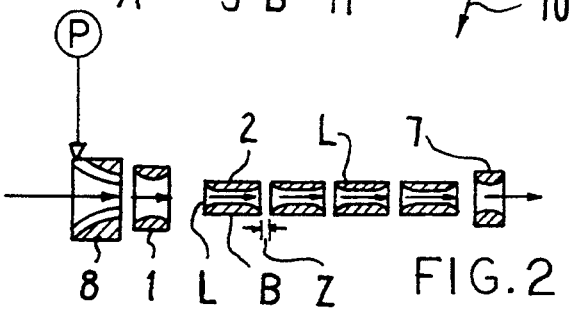
FIG. 2 shows the threading position with regard to FIG. 1.

The drive means A can be an electric motor, a pneumatic cylinder or a mechanical drive means 6, which is able to displace the holding arms 3 toward one another up to and into a threading position (FIG. 2). Optionally, the drive means 6 replaces or assists the springs (arrows 10).

On the outlet side, a stationary thread eye 7 is provided. Subsequent to said thread eye 7, a thread breakage detector D is provided, which monitors the thread Y and which produces a signal in the case of thread breakage.

By means of the signal of detector D, the drive means A is switched on, which folds the holding arms 3 to the threading position (FIG. 2) in which the thread guide elements (pressure nozzle 8, thread eye 1, brake elements B, thread eye 7) are in alignment with one another and define a continuous air guide passage. The extended thread eyes 2 define air guide surfaces L so that a stream of air (indicated by arrows in FIG. 2) passes in a straight line through the air guide passage and entrains the thread end. It will be expedient, when the intervals Z between the brake elements B are as small as possible.

As soon as the thread breakage detector D detects that the thread Y runs properly, the drive means A will be deactivated. The holding arms 3 are spread apart again for effecting a zig-zag deflection and deceleration of the thread Y passing through. Then, the pressure nozzle 8 is separated from the pressure source P, or the pressure source P, 9 is switched off.

The thread breakage detector D need not necessarily be arranged on the thread brake itself. Any suitable control means disposed in front of or behind the thread brake may fulfill this function. It is also possible to activate the drive means A by a pressure switch either by remote control and automatically or by hand so as to displace the thread brake $F_K$ to the threading position and so as to supply the pressure nozzle 8 with compressed air.

Figure 1:
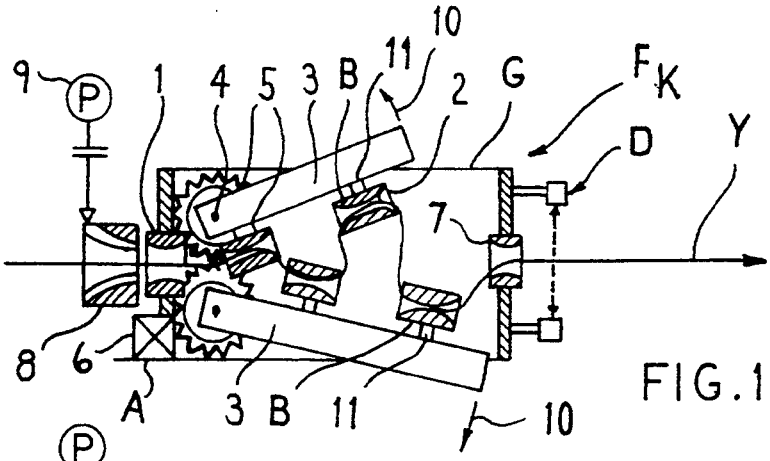
FIG. 1 shows a section through a crocodile thread brake in the braking position.
Figure 3:
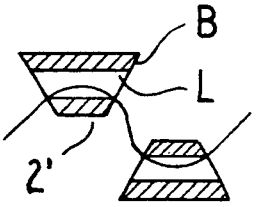
FIG. 3 shows a section of a modified detail with regard to FIG. 1, FIGS. 4 and 5 show two associated sections of an additional embodiment of the brake according to FIG. 1.

According to the variation of FIG. 3, the brake elements B in FIG. 1 can be thread eyes 2' having a trapezoidal configuration when seen in a longitudinal section, said thread eyes defining with their longer internal hole parts the air guide surfaces L and complementing each other in the threading position according to FIG. 2 in such a way that a continuous air guide passage is defined. During normal operation of the thread brake, the short internal hole parts of the thread eyes 2' act as desirably short deflection areas for a predeterminable braking effect. It would also be possible to provide, instead of the normally used short, annular thread eyes, modified thread eyes 2, 2' so as to make the thread brake $F_K$ suitable for automatic threading.

Figure 4:
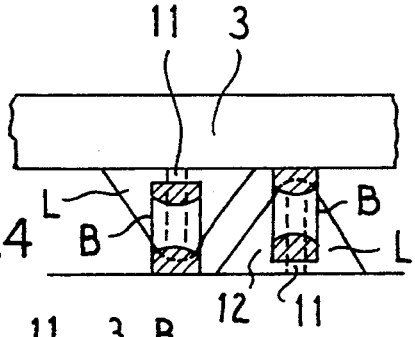
Figure 5:
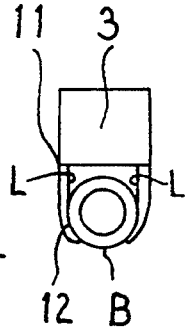

According to the variation of FIG. 4 and 5, the holding clips 11 of the holding arms 3 are extended to form wings or flanges 12, which are disposed on opposite longitudinally extending sides of each brake element B. These wings define air guide surfaces L and interfit to define the air guide passage when in the threading position. Ordinary, annular and short thread eyes can be used as braking elements B in this case. The wings 12 can be formed integrally with the holding arms 3.

Figure 6:
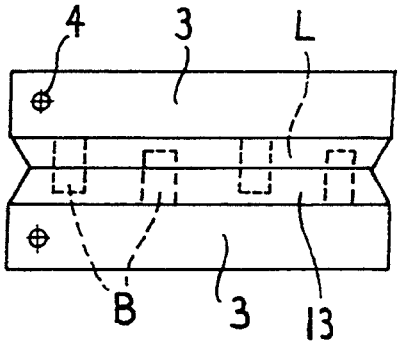
FIG. 6 shows a side view of part of an additional embodiment of a brake.
Figure 7:
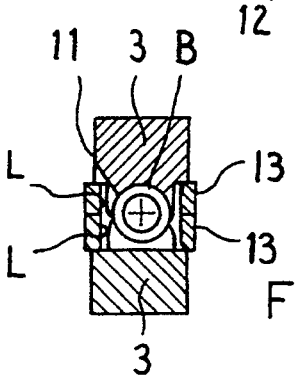
FIG. 7 shows a cross-section with regard to FIG. 6, FIGS. 8 and 8A show cross-sections through additional embodiment.

Also according to the variation of FIG. 6 and 7, short, annular thread eyes B are provided at large axial distances from one another. The holding arms have attached thereto longitudinally extending side flanges or webs 13, which cooperate with each other in the threading position (FIG. 6 and 7), said webs defining the air guide surfaces L and delimiting the air guide passage from outside. The holding clips 11 for the brake elements B can be provided separately from said webs 13. However, it would also be possible to construct the holding clips 11 as webs 13.

Figure 8:
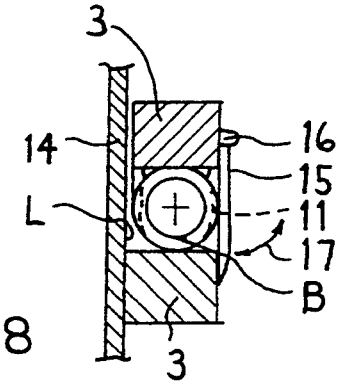
Figure 8A:
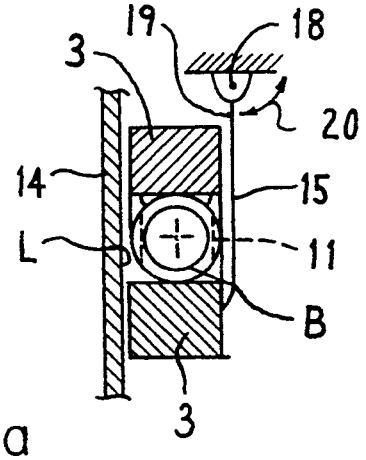

In the case of the embodiment of FIG. 8, a continuous wall 14 of the basic frame member is provided as an air guide surface L on the left side of the holding arms 3, said air guide surface L extending in close proximity to the holding arms and the brake elements B. In order to clearly show an additional alternative, a flap 15 is provided on the upper holding arm 3 on the right-hand side, said flap 15 being adapted to swing about a swivel bearing 16 in the direction of a double arrow 17 and serving as an air guide surface L in the threading position. Alternatively, as shown in FIG. 8A a flap 19 may be supported on the basic member G such that it is adapted to swing about a bearing 18 in the direction of a double arrow 20 and serve as an air guide surface which, upon displacement to the threading position, is moved into contact with the holding arms 3 for delimiting the air guide passage. In the case of the movable air guide surface (flap 15 or flap 19), the movement by means of which the holding arms 3 are displaced to the threading position can be used for deriving therefrom also the movements required for moving the flaps.

Figure 9:
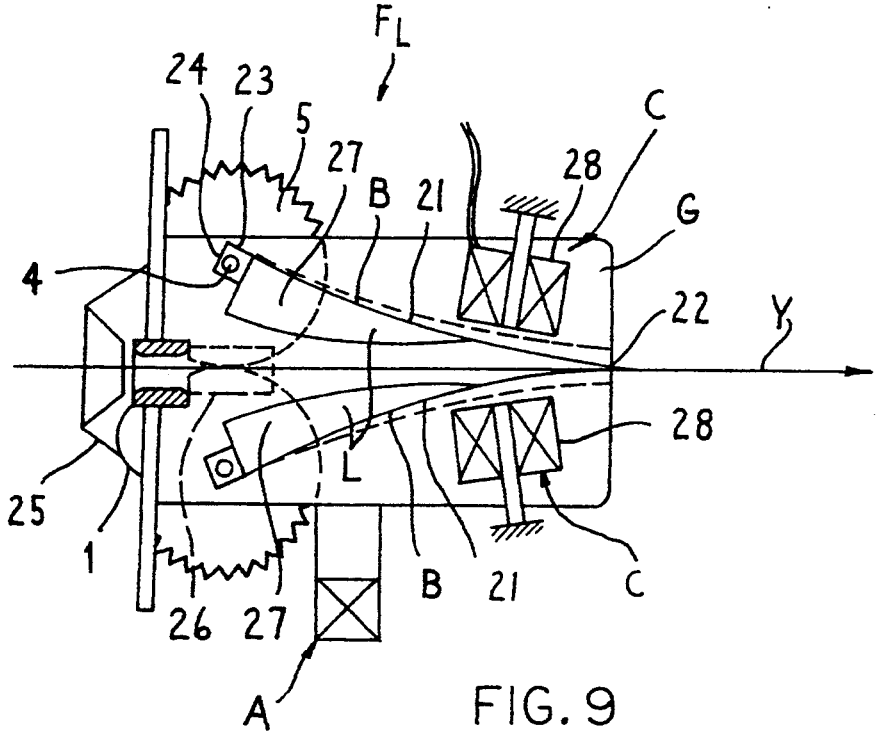
FIG. 9 shows a section through a lamella brake in the braking position, the threading position being indicated by a broken line.
Figure 10:
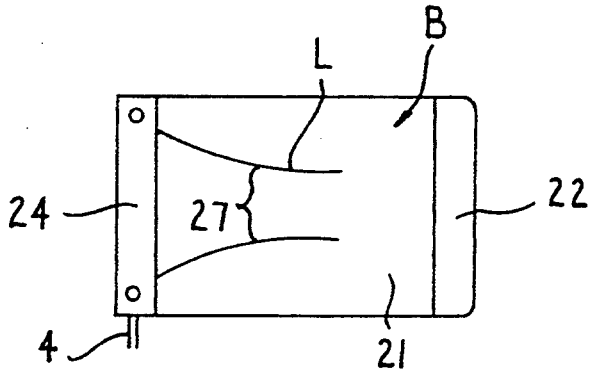
FIG. 10 shows a detail of FIG. 9.

FIG. 9 and 10 disclose a lamella brake $F_L$ suitable for automatic threading. The basic frame member G has secured thereto two elongate platelike brake elements B (resilient lamellae 21) having fastening areas 23 at the ends thereof which, by means of the gears 5, are adapted to be rotated about the pins 4 in opposite directions in such a way that the lamellae 21 are urged towards one another with a biasing force and define a braking nip. The ends 22 of the lamellae 21 are flattened. The gears 5 are acted upon by a drive means A, e.g. a mechanical drive means coupled to a drive source. This permits not only a variation of the biasing force of the two lamellae 21 but also outward displacement of said lamellae 21 to the threading position (indicated by broken lines).

The basic member has secured thereto a stationary thread eye 1, which is preceded by a pressure nozzle 25. Furthermore, an air guide passage 26, which is extended from the thread eye 1 up to a location between the lamellae 21, is indicated by a broken line. The surfaces of the lamellae 21 facing each other have provided thereon air guide surfaces L in the form of webs 27, which extend along an initial longitudinal section of the lamellae and which converge e.g. in the thread passing direction (FIG. 10). The webs 27 can be soft-elastic rubber lips, which are attached by means of an adhesive and which do not impair the resilient properties of the lamellae 21.

For the purpose of automatic threading, the lamellae 21 are displaced to the threading position according to FIG. 9, which is indicated by a broken line, before a stream of air will blow the free thread end through the air guide passage 26 and between the air guide surfaces L of the lamellae 21.

In FIG. 9, another drive means C for the lamellae 21 are indicated, which are defined by magnets 28 secured in position on the basic member G in a stationary manner. It will be expedient when the magnets 28 are proportional magnets whose magnetic force generated in the (metallic) lamellae 21 is proportional to the current applied. The magnets 28 can fulfill a double function. On the one hand, it will be possible to vary, in the case of a set adjustment of the gears 5 and of the contact pressure of the lamellae 21, the contact force and the braking effect without adjusting the gears 5 by means of the magnets 28. On the other hand, the two magnets 28 are also capable of moving the lamellae 21 to the threading position, which is indicated by the broken line, without adjusting the gears 5. For automatic threading, it will suffice to excite the magnets 28 and to simultaneously blow the stream of air through the air guide passage so as to lead the thread end through the thread brake $F_L$. When the thread guide passage 26 has a sufficient length, the webs 27 on the lamellae 21 can be dispensed with.

It is also imaginable that, upon adjusting the thread brake $F_L$ to the threading position, thread guide surfaces are moved from outside between the lifted lamellae 21. In this case, the air guide passage 26 could be dispensed with.

Figure 11:
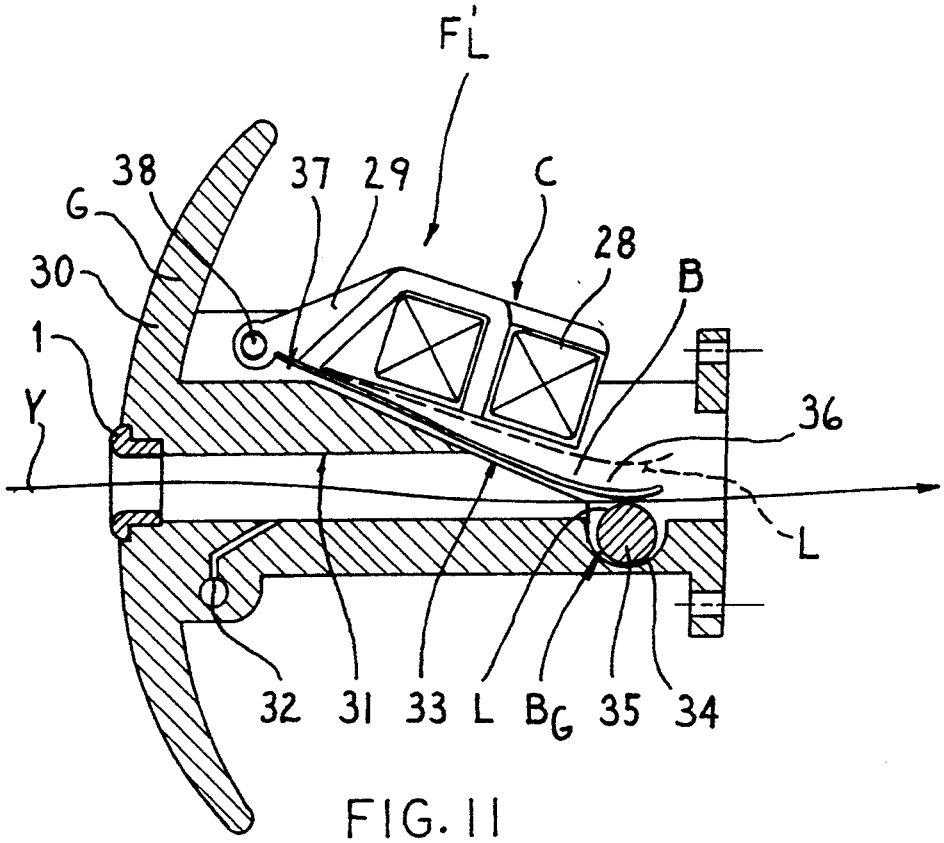
FIG. 11 shows a section through a different lamella brake in the braking position, the threading position being indicated by a broken line.
Figure 12:
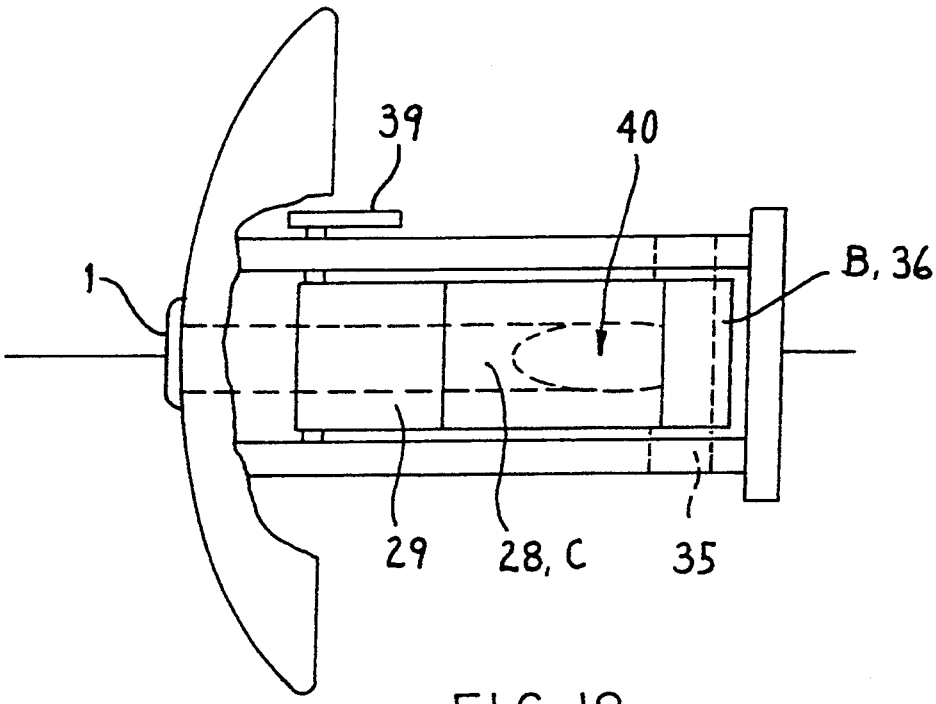
FIG. 12 shows a top view of FIG. 11.

FIGS. 11 and 12 show a different thread brake $F'_L$ (lamella brake), which is suitable for automatic threading and which, in comparison with the preceding embodiment, is characterized e.g. by only one lamella 36 as an active brake element B.

In the mushroom-shaped basic frame member G, an air guide passage 31 is formed as an extension of the stationary thread eye 1, said air guide passage extending up the lamella 36 and ending with an oval mouth 40 in the wall 33 extending approximately parallel to the lamella, which wall 33 is in a plate which is inclined or aslant relative to the longitudinal extent of passage 31 (i.e., the thread feeding direction). The wall 33 is part of a tubular component 30 of the basic member G, which, at the side opposite the lamella 36, is extended up to the end of the basic member G. In a recess 34, a stationary raised portion 35 in the form of a transverse pin is provided, the contour of said raised portion projecting only slightly above the contour of the passage 31. The bent end of the lamella 36 rests on the raised portion 35 in the normal operating position (shown by solid lines in the drawing). The lamella 36 is adapted to be raised to the threading position (indicated by broken lines). In said threading position, the bottom side of the lamella 36 defines with its bent end section an air guide surface L leading, together with the air guide surface defined by the curved contour of the raised portion 35, the stream of air from the passage 31 up to the end of the basic member G. The raised portion 35 is a passive counter brake element $B_G$. A threading air nozzle 32 leads obliquely into the air guide passage 31 in the travelling direction of the thread Y for generating the stream of air required for automatic threading.

The basic member G has provided thereon an armlike holder 29, which is adapted to be swivelled about a crosspin 38. The holder 29 can be swivelled about the pin 38 by means of an operating arm 39. It will be expedient when the swivel bearing is of the self-locking type. In view of the fact that the lamella 36 is fixedly attached to the holder 29 at 37, the rotary position of the holder 29 will determine the contact pressure of the lamella 36 on the raised portion 35. The holder 29 has secured thereto the drive means C in the form of a magnet 28 by means of which it is possible to modulate the contact pressure of the lamella 36 and, consequently, the braking effect as well as to move said lamella 36 to the threading position, which is shown by a broken line in the drawing. A predetermined intermediate gap, which is adapted to the range of the magnetic force, is provided between the magnet 28 and the lamella 36. Fundamentally, however, the lamella 36 and the magnet 28 are jointly attached to the holder 29 in fixed spatial relationship with one another so that, independently of the swivelling position of the holder 29, the magnet 28 will maintain approximately the same position relative to the lamella 36 and its magnetic force will produce an optimum effect.

In the position according to FIG. 11, the thread Y is decelerated. As soon as the magnet 28 is excited to a certain extent, the lamella 36 will be acted upon contrary to its biasing force; the braking effect will decrease. If thread breakage has taken place, which is detected e.g. by a thread breakage detector and announced in the form of a signal, the magnet 28 will be excited still further until the lamella 36 is drawn to its threading position. The threading air nozzle 32 has applied thereto compressed air. A strong, directed stream of air will be produced within the passage 31, said stream of air being led from the thread guide surfaces L on the bottom side of the lamella 36 and on the upper side of the raised portion 35 up to the end of the basic member located on the right-hand side in FIG. 11. The suction effect thus produced in the thread eye 1 will draw the free end of the thread, which is there kept in a standby position for automatic threading, into the passage 31 and it will pass the thread through the thread brake $F'_L$. As soon as the thread has been threaded properly, the magnet will be de-excited, the degree of de-excitation being such that it corresponds to the desired braking effect so that the lamella 36 will again be in contact with the raised portion 35. The application of pressure to the threading air nozzle 32 will be interrupted.

For varying the braking effect, it is also possible to adjust the holder 29 about the pin 38 in an appropriate manner, a drive means, which is not shown, being provided for this purpose. In the case of thread breakage, this drive means can also be used for moving the lamella 36 to the threading position by swivelling the holder 29. The threading air nozzle 32 may also be provided instead of the thread eye 1 or in front of said thread eye. It is also imaginable that a plurality of nozzle outlets is provided along the passage 31. The magnet 28 may also be provided on the opposite side of the lamella 36 in the basic member and apply pressure to the lamella 36.

We claim:

1. In a thread brake having first and second brake members positioned transversely relative to the traveling direction of a thread, the first and second brake members being relatively moveable transversely with respect to the traveling direction between a braking position in brake members act on the thread and a threading position in which the thread can be moved freely through the brake in the thread traveling direction, the improvement comprising:

drive means for relatively transversely displacing the first and second brake members into said threading position;

automatic threading means for automatically and pneumatically threading a thread through the brake by a stream of air, said threading means including (a) guide surface means defining an elongate air guide passage extending through the thread brake in the thread traveling direction when the brake members are in said threading position, and (b) selectively actuatable pressure source means for supplying a stream of air to said passage to cause threading of the thread along the passage; and said drive means being coupled to a thread breakage detector and including means for automatically relatively displacing the first and second brake members into the threading position in the case of thread breakage, and means for activating the pressure source means.

2. In a thread brake system having a thread brake which includes first and second brake members positioned transversely relative to the traveling direction of a thread, the first and second brake members being relatively moveable transversely with respect to the traveling direction between a braking position in which the brake members act on the thread and a threading position in which the thread can be moved freely through the brake in the thread traveling direction, the improvement comprising:

threading means for automatically and pneumatically threading a thread through the brake by a stream of air, said threading means including (a) guide surface means defining an elongate air guide passage extending through the thread brake in the thread traveling direction when the brake members are in said threading position, and (b) selectively actuatable pressure source means for supplying a stream of air to said passage to cause threading of the thread along the passage;

thread breakage detector means for supplying a signal upon sensing a thread breakage; and drive means for relatively transversely displacing the first and second brake members into said threading position in response to the signal from the thread breakage detector means so that a thread is fed through the passage by the stream of air to automatically thread up the thread brake.

3. A thread brake system as claimed in claim 2, wherein the drive means includes means for electromagnetically displacing at least one brake member into the threading position.

4. A thread brake system as claimed in claim 2, wherein the drive means includes means for varying the braking effect and means for displacing the first and second brake members into the threading position in a stepwise manner.

5. A thread brake system as claimed in claim 2, further comprising at least one threading air nozzle coupled to said pressure source means and directed towards the air guide passage for directing the stream of air to the air guide passage.

6. A thread brake system as claimed in claim 5, wherein the threading air nozzle defines the drive means, and the stream of air from said threading air nozzle acts on the first and second brake members in the direction of displacement towards the threading position.

7. A thread brake system as claimed in claim 5, wherein said thread brake includes a stationary thread inlet opening disposed at a feed end of said thread brake, the threading air nozzle being arranged in the area of the stationary thread inlet opening.

8. A thread brake system as claimed in claim 5, wherein the threading air nozzle is arranged within the air guide passage.

9. A thread brake system as claimed in claim 5 wherein the threading air nozzle is a pressure nozzle.

10. A thread brake system as claimed in claim 5, wherein the threading air nozzle is a suction nozzle.

11. A thread brake system as claimed in claim 2, wherein the drive means includes means for mechanically displacing at least one brake member into the threading position.

12. A thread brake system as claimed in claim 2, wherein the drive means includes means for pneumatically displacing at least one brake member into the threading position.

13. A thread brake system as claimed in claim 2, wherein the drive means includes means for varying the braking effect and means for displacing the first and second brake members into the threading position in a continuous manner.

14. A thread brake system according to claim 2, wherein said first brake member includes at least two eyelet-shaped brake elements disposed in axially aligned but spaced relation, and said second brake member includes at least one eyelet-shaped brake element which is axially positionable between and substantially aligned with the brake elements of said first brake member when said brake members are in said threading position, the brake element of said second brake member being transversely displaced and axially nonaligned with the brake elements of said first brake member to cause a transverse deflection in the thread when the brake members are in said braking position.

15. A thread brake system according to claim 14, wherein said guide surface means is defined by interior annular surfaces which are defined on said eyelet-shaped brake elements in surrounding relationship to through openings as defined by said brake elements, the axial spacing between adjacent brake elements on said first brake member being similar to the axial length of the brake element on said second brake member so that the brake elements on said first and second brake members when axially aligned are positioned in closely axially adjacent relationship to define said elongate air guide passage.

16. A thread brake system according to claim 15, wherein said brake elements have a trapezoidal-shaped longitudinal cross section so that the brake element of said second brake member will closely fit between the brake elements of said first brake member when said brake elements are in said threading position.

17. A thread brake system according to claim 14, wherein each brake member comprises an elongate arm having the respective brake element projecting transversely from one side thereof generally toward the other brake member, at least one said arm being transversely movable between said braking and threading positions, said guide surface means includes flanges fixed to each arm in the longitudinal direction thereof and projecting outwardly adjacent opposite sides of the brake elements, said flanges on the arms defining said first and second brake members projecting generally toward one another and cooperating in the threading position to define therebetween the elongate guide passage in which said brake elements are disposed.

18. A thread brake system according to claim 14, wherein each brake member comprises an elongate arm having the respective brake element projecting transversely from one side thereof generally toward the other brake member, at least one said arm being transversely movable between said braking and threading positions, said guide surface means including a stationary wall disposed closely adjacent and extending longitudinally along one side of said arms for closing off one side of the region between said arms in which said brake elements are disposed.

19. A thread brake system according to claim 18, including a longitudinally elongate closure flap disposed adjacent and extending longitudinally along the other side of Said arms for closing off the other side of the region defined therebetween so that said brake elements are confined sidewardly between said stationary wall and said closure flap.

20. A thread brake system according to claim 2, wherein said first brake member comprises a first elongate platelike brake element swingably movable generally transversely with respect to the thread traveling direction within a longitudinally extending plane, said first brake element having a downstream end defined by a free tip portion disposed for engaging the thread when in said braking position, and said second braking member comprising a second brake element which also engages the thread in generally opposed relationship to the first brake element when the latter is in said braking position so that the thread is directly sidewardly engaged between the first and second brake elements.

21. A thread brake system according to claim 20, wherein said second brake element is also defined by an elongate platelike member which is transversely movable in a plane extending longitudinally along the thread traveling direction and has a free tip portion disposed downstream for engagement with the thread directly across from the tip portion of the first brake element when the brake elements are in said braking position, said drive means causing the tip portions of both brake elements to be moved transversely in opposite direction away from one another and away from the thread when in said threading position, said first and second brake elements having opposed enlarged surfaces which are defined on transversely opposed faces of said first and second brake elements, and said guide surface means including a pair of sidewardly-spaced but longitudinally elongated guide flanges projecting outwardly away from the opposed face of each brake element generally toward the other brake element, said flanges cooperating with one another to define said elongate guide passage therebetween when said brake elements are in said threading position for permitting guiding of an air stream therealong.

22. A thread brake system according to claim 21, wherein the pair of sidewardly-spaced guide flanges associated with each brake element converge as the guide flanges project longitudinally in the downstream direction.

23. A thread brake system according to claim 22, including a stationary and elongate sleevelike air guide member disposed in axial alignment along said traveling direction directly adjacent an upstream end of the passage defined between said guide flanges, said pressure source means supplying an air stream to the upstream end of said air guide

24. A thread brake system according to claim 20, wherein the guide surface means includes a housing having an elongate passage extending therethrough and defining said air guide passage, said second brake element being stationarily mounted on said housing adjacent a downstream end of said elongate passage, said first brake element being swingably mounted on maid housing for transverse swinging movement within a generally longitudinally extending plane so that said first brake element extends transversely across and in slanted relationship to said elongate passage adjacent the downstream end thereof so that the thread is sidewardly engaged between maid stationary brake element and the tip portion of said first brake element.

25. A thread brake system as claimed in claim 24, wherein said first brake element is a lamella, said thread brake further including at least one magnet positioned adjacent to a side of the lamella facing away from the stationary brake element, said lamella is adapted to be displaced relative to said stationary brake element by means of said magnet.

26. A thread brake system as claimed in claim 25, wherein the magnet and the lamella are jointly attached to a holder in predetermined relative association with each other and with an interspace therebetween, the holder being swingably mounted on said housing for transverse swinging movement.

* * * * *

UNITED STATES PATENT AND TRADEMARK OFFICE

CERTIFICATE OF CORRECTION

PATENT NO. : 5 368 244

DATED : November 29, 1994

INVENTOR(S) : Michele MELILLO, et al.

It is certified that error appears in the above-indentified patent and that said Letters Patent is hereby corrected as shown below:

Column 7, line 41; after "in" insert ---which the---.

Column 8, line 55; after "5" insert ---,---.

Column 9, line 60; change "Said" to ---said---.

Column 10, line 41; after "guide" insert ---member.---.

line 48; change "maid" to ---said---.

line 53; change "maid" to ---said---.

Signed and Sealed this

Eighteenth Day of April, 1995

Bruce Lehman

*Attest:*

BRUCE LEHMAN

*Commissioner of Patents and Trademarks*

*Attesting Officer*